US005803632A

United States Patent [19]

Grossman

[11] Patent Number: 5,803,632

[45] Date of Patent: Sep. 8, 1998

[54] METHOD AND APPARATUS FOR PREVENTING ENVELOPE FLAPS FROM SEALING IN LASER PRINTERS

[76] Inventor: Carl Grossman, 1410 Castec Dr., Sacramento, Calif. 95864

[21] Appl. No.: 663,382

[22] Filed: Jun. 13, 1996

[51] Int. Cl.[6] ..... B41J 13/12

[52] U.S. Cl. ..... 400/626; 400/622; 229/68.1; 229/80.5; 271/2

[58] Field of Search ..... 400/622, 625, 400/626; 229/80, 68.1, 68.2, 76, 79, 80.5, 900, 928, 930; 270/1.01, 1.02, 1.03; 271/2; 347/218; 399/361

[56] References Cited

U.S. PATENT DOCUMENTS

| | | | |
|---|---|---|---|
| 1,288,252 | 12/1918 | Staley | 271/2 |
| 4,807,805 | 2/1989 | Rutkowski | 229/69 |
| 4,822,017 | 4/1989 | Griesmyer | 271/2 |
| 4,837,061 | 6/1989 | Smits et al. | 428/40 |
| 4,846,455 | 7/1989 | Hurst | 271/2 |
| 4,869,485 | 9/1989 | Enix | 271/2 |
| 4,915,288 | 4/1990 | Kao et al. | 229/80 |
| 4,948,028 | 8/1990 | Vollowitz | 229/80 |
| 5,114,067 | 5/1992 | Martin et al. | 229/92.1 |
| 5,253,798 | 10/1993 | Lombardo | 229/92.1 |
| 5,342,556 | 8/1994 | Traubel et al. | 264/2.7 |
| 5,450,187 | 9/1995 | Pei et al. | 355/311 |

*Primary Examiner*—David A. Wiecking
*Attorney, Agent, or Firm*—Oppenheimer Poms Smith

[57] ABSTRACT

An insert for preventing a gummed flap from adhering to an envelope while being printed upon in a laser printer is substantially nonadherent to moister-activated and/or heat-activated gums and adhesives. The nonadherent insert is made from sheet material which is configured to correspond to flaps of commonly used envelopes. The insert is positioned between the gummed flap and a body portion of an envelope to be printed upon prior to feeding the envelope into a laser printer. The insert prevents the gum of the flap, which may be activated by the heat inside a laser printer, from adhering to the body of the envelope. The insert is removed from the envelope after printing and may be repeatedly used.

12 Claims, 2 Drawing Sheets

METHOD AND APPARATUS FOR PREVENTING ENVELOPE FLAPS FROM SEALING IN LASER PRINTERS

BACKGROUND OF THE INVENTION

1. Field of the Invention

The present invention relates to methods and apparatus associated with printing upon envelopes in printers and, more particularly, to methods and apparatus which prevent an envelope flap from adhering to an envelope while being printed upon in a laser printer.

2. Description of Related Art

The laser printer has become ubiquitous throughout business and industry, and may also be found in many homes. In addition to affordable prices, laser printers have enjoyed popularity because of their superiority to other types of printers in terms of print quality, font selection, color printing, speed, versatility, and so on.

In order to print, laser printers employ drums and other parts which may attain temperatures in the range of 375° Fahrenheit (F.) to 450° F. Indeed, most users of laser printers are familiar with the warning labels on the inside of the printers, cautioning the user of hot surfaces.

Along with normal paper, envelopes may be addressed and/or printed upon in laser printers. Envelopes have gummed flaps which seal letters and other papers inside the envelope. The gum or adhesive used on the envelopes is often moisture activated—that is, the gum becomes sticky or adherent upon the application of water (commonly in the form of saliva from the user's tongue). However, the gum used on envelopes may also be activated by high temperatures, particularly in humid environments.

Accordingly, one of the drawbacks in using laser printers for addressing envelopes is that the flap of an envelope may adhere to the back of the envelope. If the adherence is light (i.e., the flap is slightly stuck to the back of the envelope), a user may simply detach the flap and use the envelope normally. However, if the adherence is strong (i.e., the flap is substantially sealed to the back of the envelope), the user may not be able to detach the flap without damaging the envelope, in which case the envelope would have to be discarded. This is wasteful not only from the point of view of wasted stationary, but also from the point of view of inefficiency in that another envelope needs to be addressed with the laser printer or, alternatively, with a typewriter.

SUMMARY OF THE INVENTION

It is an object of the present invention to provide a method and an apparatus which mitigate and/or obviate the aforementioned drawbacks involved in printing envelopes in laser printers.

It is another object of the invention to provide a method and an apparatus which prevent an envelope from sealing while being printed upon in a laser printer.

It is a further object of the invention to provide a method and an apparatus which substantially eliminate the waste of envelopes resulting from sealing in a laser printer.

It is yet another object of the present invention to provide a method and an apparatus which prevent envelopes from sealing in laser printers in an easy and efficient manner.

According to one aspect of the present invention, an apparatus for preventing an envelope from sealing while being printing upon in a printer includes a nonadherent insert made from flexible sheet material which is substantially nonadherent with activated gums and/or adhesives. Commonly used envelopes have a body portion and a flap integral with the body portion along a fold line. The flap has gum applied to an inside surface for sealing the flap to the body portion. The gum is activated by moisture and/or heat. The nonadherent insert is configured to ensure that no portion of the gum of the flap contacts the body portion of the envelope when the nonadherent insert is positioned between the flap and the body portion.

According to one preferred embodiment of the nonadherent insert of the present invention, the nonadherent insert has an inner edge which is configured to correspond to the fold line of the envelope. The nonadherent insert is then configured such that the gum of the flap contacts the nonadherent insert when the inner edge is positioned along the fold line of the envelope. Preferably, the nonadherent insert is configured to correspond to the shape of the flap of the envelope.

According to another aspect of the present invention, a method for preventing an envelope from sealing while printing in a laser printer is provided. The method includes the steps of providing a flexible insert which is substantially nonadherent to activated gums applied on a flap of the envelope. The flexible insert is then positioned between the gum on the flap and a body portion of the envelope. The envelope is then fed into the laser printer with the flexible insert positioned between the flap and the body portion. The flexible insert is then removed from the envelope.

One of the advantages of the present invention is that the flexible insert may be repeatedly used. The insert is preferably made from non-porous sheet material such as a plastic sheet material or mylar. Therefore, according to a preferred embodiment of the invention, the nonadherent insert may be positioned between the flap and the body portion of another envelop and fed through the laser printer. This method may proceed for numerous subsequent envelopes.

Other aspects, features, and advantages of the present invention will become apparent to those skilled in the art from a reading of the following detailed description with reference to the accompanying drawings.

DETAILED DESCRIPTION OF THE RELATED ART

With reference to the drawings, there are shown exemplary embodiments of a nonadherent envelope insert 10 in accordance with the present invention. The insert 10 prevents the gummed flap of an envelope from sticking or adhering to the envelope when the envelope is fed through a laser printer for printing.

Figure 1:
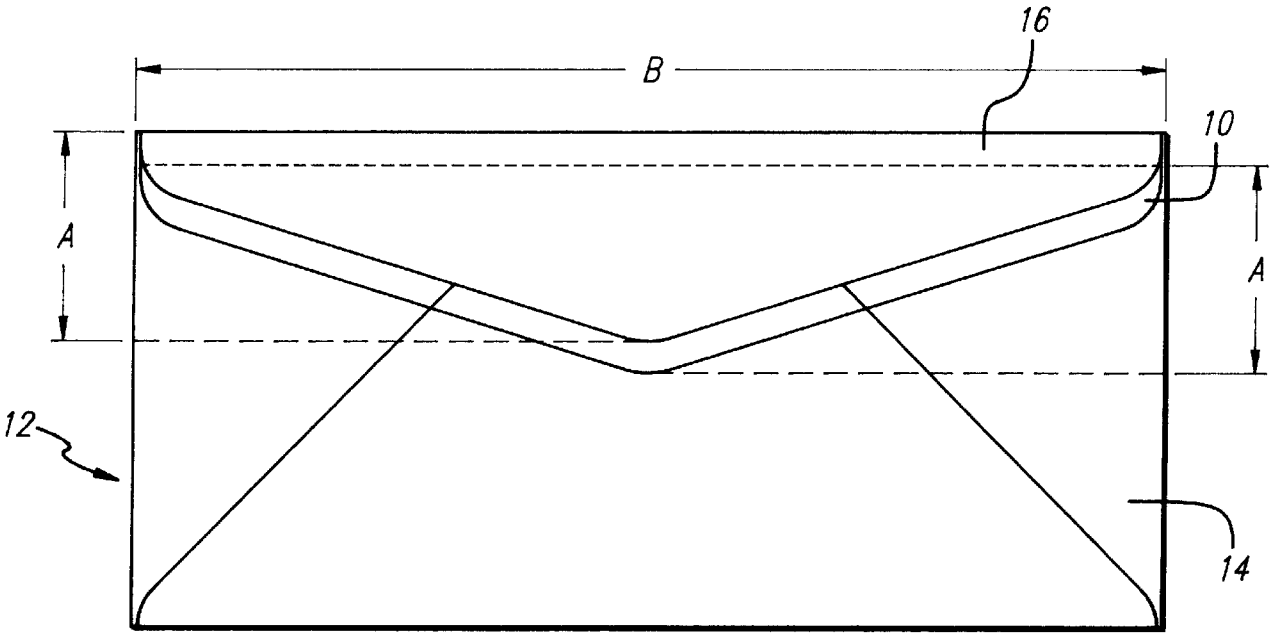
FIG. 1 is a plan view of a nonadherent envelope insert positioned between a flap and a body portion of an envelope in accordance with the principles of the present invention.

With particular reference to FIG. 1, the insert 10 is made from flexible sheet material which is nonadherent to activated gums and adhesives which, that is, gums and adhesives which are tacky or sticky. This nonadherent quality of the insert 10, as well as other aspects and features of the present invention, will be discussed in more detail below, after the following background discussion of envelopes and laser printers.

Figure 2:
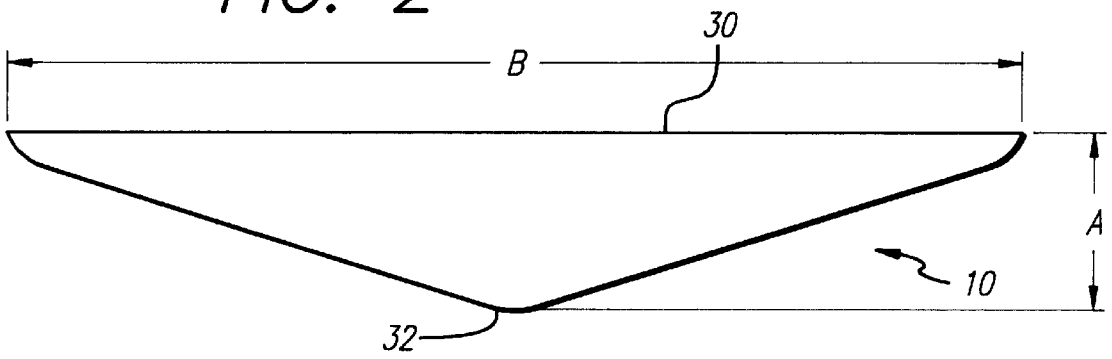
FIG. 2 is a plan view of a nonadherent envelope insert in accordance with a preferred embodiment of the present invention.
Figure 3:
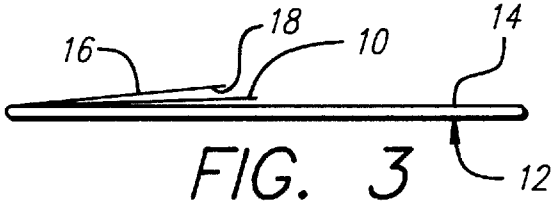
FIG. 3 is a cross-sectional view of a nonadherent envelope insert positioned between a flap and a body portion of an envelope in accordance with the principles of the present invention.

An envelope commonly used in business, industry, and households is a No. 10 envelope. A No. 10 envelope measures approximately 4⅛ inches by 9½ inches. An example of a No. 10 envelope is shown in FIGS. 2 and 3 and is generally indicated by reference numeral 12. The envelope 12 has a body portion 14 and a flap 16 pivotally integral with the body portion 14 along a fold line. Contents to be sealed in the envelope 12 are inserted and held in the body portion 14. The flap 16 has a layer of gum or adhesive 18 applied to an inside surface thereof for sealing the flap 16 to the body portion 14, thereby securing the contents in the envelope 12.

Figure 4:
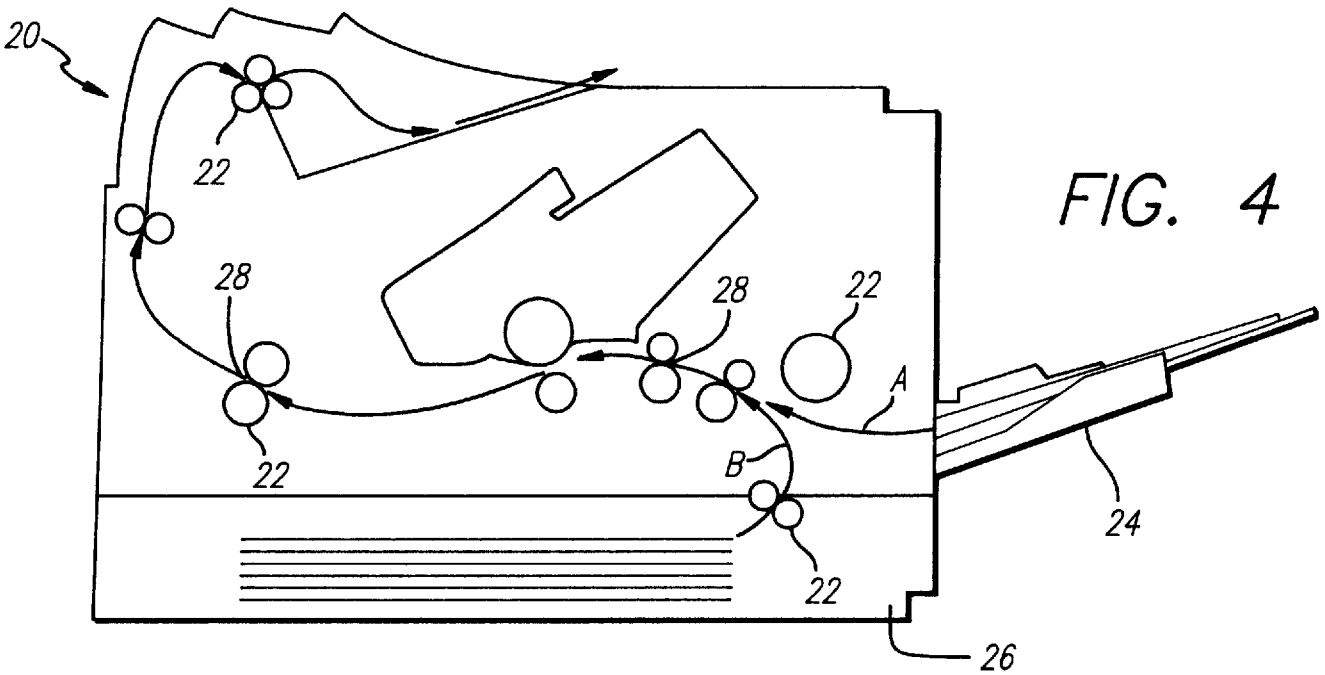
FIG. 4 is a schematic view of a laser printer particularly showing internal components thereof.

Turning to laser printers, laser printers contain components which attain high temperatures in order to print. For example, many of the commonly used Hewlett-Packard™ laser printers, an example of which is shown in FIG. 4 and indicated by reference numeral 20, have drums and other components which may attain temperatures in the neighborhood of 375° F. to 450° F. Further, the "effective" temperature of many of the components of the printer 20 relative to printing stock being fed through the printer 20 may be in the range of 175° F. to 350° F. The printer 20 includes a plurality of rollers 22 which load printing stock, such as paper and envelopes, from either an external loading tray 24 (shown by path A) or a built-in loading tray 26 (shown by path B) and propel the printing stock on a relatively tortuous path through the printer 20. Envelopes to be addressed are typically loaded into the printer 20 by using the external loading tray 24. In order to propel the printing stock through the printer 20, each of the sets of rollers 22 compresses the printing stock through a nip 28, which is defined as the narrowest point or the point of contact between two rollers. The force exerted by the rollers 22 at the nip 28 may be on the order of several pounds per square inch.

The high-temperature environment inherent in laser printers such as that shown in FIG. 4 may soften and/or activate gums and adhesives which are used for sealing envelopes. Accordingly, if the gum 18 is softened or activated, the flap 16 may become sealed to the body portion 14 of the envelope 12. Further, these high temperatures may also evaporate moisture which may be present in the material from which the envelope 12 is made, thereby causing the resultant vaporized moisture to moisten and to activate the layer of gum 18 on the flap 16. Further augmenting possible sealing of the envelope 12 is the pressure exerted by the rollers 22, which pressure compresses the flap 16 against the body portion 14 much like a user may do when sealing envelopes by hand. Although a laser printer is shown to illustrate the principles of the present invention, the nonadherent insert 10 will function equally as well with other types of printers, such as laser-jet printers, impact printers, thermal printers, solid-ink printer, and so on, which may also employ rollers and/or heated components.

In addition to the gum-activating, high-temperature internal environment of printers, printers print sheets of paper at different speeds. Although many of the more expensive printers prints at speeds of up to eight pages per minute, many printers print at about four pages per minute. As can be realized, the slower the printer, the longer time the printing stock remains in the torrid internal environment of the printer. Accordingly, if the envelope 12 is being printed upon in a slower generation printer, then there is a longer time and, hence, a greater possibility for the gum 18 to become softened and/or adherent.

With further reference to FIG. 2, the nonadherent envelope insert 10 is preferably configured to correspond to the shape or configuration of the gummed flap 16 of the envelope 12. Accordingly, for the exemplary No. 10 envelope shown, the insert 10 may have a substantially linear side or inner edge 30 which corresponds to the portion of the flap 16 which is integral with the body portion 14 of the envelope (i.e., the fold line), and a triangular side or outer edge 32 which corresponds to the portion of the flap 16 on which the gum 18 is applied. As shown in the drawings, the length of the inner edge 30 may be substantially equal to the dimension of the envelope 12 indicated by the letter B, and the height of the triangular outer side 32 may be substantially equal to the dimension of the envelope 12 indicated by the letter A.

Alternatively, as No. 10 envelopes (as well as many other types of envelopes) may have substantially rectangular flaps, the nonadherent insert 10 may be configured to be substantially rectangular, with dimensions of approximately A by B. Therefore, the insert 10 may be used equally effectively as a correspondingly configured insert with envelopes with triangular flaps, as well as with envelopes with rectangular flaps. Accordingly, although the inner edge 30 of the insert 10 may be substantially straight for all envelopes, the outer edge 32 may be either correspondingly configured for the specific shapes of various flaps or generally configured to accommodate more than one shape or configuration of flap.

Referring to the gum 18 applied on the inside of the flap 16 of the envelope 12, the gum 18 is typically of the type which is activated or becomes adherent upon being moistened. Many gums used in manufacturing envelopes also become softened and/or activated when exposed to high-levels of heat, such as those found in laser printers. In any case, the gum 18 is typically not tacky, i.e., the gum is inactive, at room temperatures and at levels of humidity which are not excessive.

As mentioned above, the insert 10 is made from flexible sheet material which is substantially nonadherent to activated gums and adhesives or to already tacky gums. For example, the insert 10 may be made from sheet material having a silicone-based release coating applied thereon. The sheet material is preferably a non-porous material such as a plastic- or metallic-based material or a substantially non-porous paper or card stock. For example, the nonadherent insert 10 may be made from polyethylene teraphthalate, which is commonly known as mylar. It is preferable for the insert 10 to be made from sheet material which is relatively durable (as opposed to, for example, tissue paper) so that the insert 10 may be repeatedly used and substantially unaffected by the high-temperature environment of laser printers. Moreover, in order to withstand the relatively high temperatures in laser printers, the sheet material from which the insert 10 is made is also preferably heat resistant as well as inert.

With particular reference to FIG. 3, as the nonadherent insert 10 is made from sheet material, the thickness of the insert 10 may be comparable to the thickness of the material from which the envelope 12 is made. However, the thickness of the sheet material from which the insert 10 is made may vary widely as long as the total thickness of the insert 10 and the envelope 12 is within the non-jamming operating thickness range of the laser printer to be used. The operating thickness range for most laser printers is approximately 2 mils to 15 mils. Therefore, the combined thickness of the envelope and the insert 10 should be within this range. Generally speaking, commonly used envelopes may range in thickness from about 4 mils to about 10 mils. Accordingly, the thickness of the nonadherent insert 10 (i.e., the thickness of the sheet material from which the insert 10 is made) is preferably in the range of about 5 mils to 10 mils.

In operation, the nonadherent envelope insert 10 is positioned between the gummed flap 16 and the body portion 14 of the envelope 12 to be printed upon in the laser printer. It may be preferable for the user to position the nonadherent insert 10 such that a portion of the insert 10 extends beyond the outer edge of the flap 16 for easier removal after printer. The envelope 12 with the nonadherent insert 10 positioned between the gummed flap 16 and the body portion 14 is then placed on the loading tray of the laser printer or fed directly into the laser printer for printing. After printing, the insert 10 is removed from the envelope 12 which may then be stuffed and sealed. The nonadherent insert 10 may be repeatedly used for the printing of additional envelopes.

As is known in the art of envelopes, the pattern by which the gum 18 is applied to the inside of the flap 16 varies. Some envelopes may have gum applied along the entire outer inside edge of the flap, while others may only have two or three gummed areas on the inside surface of the flap. Accordingly, a user may correspondingly position the nonadherent insert 10 to ensure that the insert 10 is positioned between at least the gummed areas 18 and the body portion 14 of the envelope. Overall, it is preferable for the dimensions of the insert 10 to be slightly greater than the dimensions of the flap 16 so that the entire flap 16 abuts or is in contact with the insert 10 to ensure that no portion of the gum 18 contacts the body portion 14. In such a preferred embodiment, the outer edge 32 of the insert 10 slightly projects out from under the flap 16 when the inner edge 30 is positioned against the fold line of the envelope 12.

Although a No. 10 envelope is used to illustrate an exemplary embodiment of the invention, the nonadherent insert 10 may be configured for any size and type of envelope which is used in laser printers. For example, envelopes measuring (in inches) 6 by 9, 9 by 12, 10 by 13, 10 by 15, and 12 by 15½ are commonly used in business and at home. These envelopes typically have rectangular flaps. Accordingly, the nonadherent insert 10 is preferably configured to correspond to the more rectangular flaps for use with these envelopes. Further, the insert 10 may be used with envelopes made from any type of material, including bond, kraft paper, light-weight airmail paper, and Tyvek™.

In the commercial production of the envelope insert 10, large sheets of material may be die cut in the desired configuration for packaging. Alternatively, smaller sheets of material, e.g., 8½ by 11 inches, may be die cut with perforations into a plurality of inserts 10 so that a user can buy the sheet of inserts 10 and remove an insert as needed. Further, a single sheet of material may be die cut into various configurations of inserts; for example, one insert may be configured for No. 10 envelopes with triangulated flaps; another insert may be configured for a 9-by-12 envelopes with rectangular flaps; and so on. Therefore, a user may purchase one insert sheet which contains variously configured inserts for many different envelopes.

Those skilled in the art will appreciate that the present invention may be embodied in other specific forms without departing from the spirit or central attributes thereof. In that the foregoing description of the present invention discloses only an exemplary embodiment, it is to be understood that other variations are contemplated as being within the scope of the present invention. Accordingly, the present invention is not limited to the particular embodiments which have been described in detail herein. Rather, reference should be made to the appended claims as indicative of the scope and content of the present invention.

What is claimed is:

1. A method for preventing an envelope from sealing while printing in a printer which generates heat, the envelope having a flap and a body portion, the flap having gum applied to an inside surface thereof, the method comprising the steps of:

(a) providing a flexible insert, (b) positioning the flexible insert between the gum on the flap and the body portion of the envelope, the flexible insert being nonadherent to the gum;

(c) feeding the envelope with the flexible insert positioned between the flap and the body portion through the printer, and (d) removing the flexible insert from the envelope when the envelope is discharged from the printer;

(e) repeating steps (b) through (d) with the same flexible insert.

2. A method for preventing an envelope from sealing while printing in a printer which generates heat in an effective temperature range of approximately 175° Fahrenheit (F.) to 350° F., the envelope having a flap and a body portion, the flap having gum applied to an inside surface thereof, the method comprising the steps of:

(a) providing a flexible insert which is nonadherent to the gum of the flap when the gum is either active or inactive and which is resistant to heat within the effective temperature range of the printer;

(b) positioning the flexible insert between the gum on the flap and the body portion of the envelope;

(c) feeding the envelope with the flexible insert positioned between the flap and the body portion through the printer; and (d) removing the flexible insert from the envelope when the envelope is discharged from the printer.

3. The method of claim 2 wherein the flexible insert is configured substantially the same as the flap of the envelope.

4. An apparatus for preventing an envelope from sealing while being printed upon in a printer which generates heat in an effective temperature range of approximately 175° Fahrenheit (F.) to 350° F., the envelope having a body portion and a flap integral with the body portion along a fold line, the flap having gum applied to an inside surface thereof for sealing the flap to the body portion, the apparatus comprising:

an insert made from flexible sheet material with which the gum is nonadherent when active or inactive, the sheet material being resistant to heat in the effective temperature range of the printer;

the insert being configured to ensure that no portion of the gum of the flap contacts the body portion of the envelope when the insert is positioned between the flap and the body portion.

5. The apparatus of claim 4 wherein the insert has an inner edge and an outer edge;

the inner edge being configured to correspond to the fold line of the envelope;

the insert being configured such that the gum of the flap contacts the insert when the inner edge of the insert is positioned along the fold line of the envelope and the envelope is fed into the printer.

6. The apparatus of claim 5 wherein the insert is configured to correspond substantially to the shape of the flap of the envelope.

7. The apparatus of claim 5 wherein the insert is configured such that the outer edge projects out from under the flap when the inner edge is positioned along the fold line of the envelope.

8. The apparatus of claim 4 wherein the sheet material is substantially non-porous.

9. The apparatus of claim 4 wherein the insert is reusable a plurality of times.

10. An envelope and insert in combination, the insert for preventing the envelope from sealing when fed through a printer for printing, the printer having an effective temperature range of approximately 175° Fahrenheit (F.) to 350° F. the combination comprising:

an envelope having a body portion and a flap integral with the body portion along a fold line, the flap having gum applied to an inside surface thereof for sealing the flap to the body portion, the gum being at least partially activated when subjected to heat and/or moisture; and an insert made from flexible sheet material which is nonadherent with the gum when activated;

the insert being positionable between the flap and the body portion of the envelope;

the insert being configured such that the gum contacts the insert when the insert is positioned between the flap and the body portion of the envelope; and the insert being resistant to heat in the effective temperature range of the printer.

11. The combination as defined in claim 10 wherein the configuration of the insert is substantially the same as the configuration of the flap of the envelope.

12. The combination as defined in claim 10 wherein the insert is reusable a plurality of times.

* * * * *